US008220471B2

(12) United States Patent
Porter et al.

(10) Patent No.: US 8,220,471 B2
(45) **Date of Patent: *Jul. 17, 2012**

(54) MULTIPURPOSE AQUEOUS PARTS WASHER

(75) Inventors: Brian E. Porter, Addison, IL (US); Michael Endres, Woodridge, IL (US); Geoffrey M. Bond, Lake in the Hills, IL (US); Theodore J. Thelin, Algonquin, IL (US); Rudy Publ, Glendale Heights, IL (US); Sean Spaziani, Flower Mound, TX (US); Alex Richert, Dallas, TX (US); Don Meisinger, Denton, TX (US)

(73) Assignee: Safety-Kleen Systems, Inc., Plano, TX (US)

( * ) Notice: Subject to any disclaimer, the term of this patent is extended or adjusted under 35 U.S.C. 154(b) by 768 days.

This patent is subject to a terminal disclaimer.

(21) Appl. No.: 11/681,652

(22) Filed: Mar. 2, 2007

(65) Prior Publication Data

US 2008/0210276 A1 Sep. 4, 2008

(51) Int. Cl.
*B08B 3/00* (2006.01)

(52) U.S. Cl. ..... 134/84; 134/114

(58) Field of Classification Search ..... 134/84
See application file for complete search history.

(56) References Cited

U.S. PATENT DOCUMENTS

| | | | |
|---|---|---|---|
| 1,395,728 | A | 11/1921 | Ormes |
| 1,525,756 | A | 2/1925 | McKenney et al. |
| 1,597,267 | A | 8/1926 | Clairmont |
| 1,617,021 | A | 2/1927 | Mitchell |
| 1,691,839 | A | 11/1928 | Caskin |
| 1,804,715 | A | 5/1931 | Tafel, Jr. |

(Continued)

FOREIGN PATENT DOCUMENTS

| | | |
|---|---|---|
| EP | 1602412 | 12/2005 |
| GB | 222306 | 10/1924 |
| GB | 1395728 | 5/1975 |

OTHER PUBLICATIONS

AaLadin Cleaning Systems; Parts Washers brochure; entire brochure.

(Continued)

*Primary Examiner* — Michael Barr
*Assistant Examiner* — Jason Ko
(74) *Attorney, Agent, or Firm* — Vedder Price P.C.

(57) ABSTRACT

A multipurpose parts washer may include an automatic cleaning portion, with a first cleaning chamber for spraying parts, a second cleaning chamber for soaking parts, and a manual cleaning portion. Cleaning solution may be disposed in a reservoir of the first cleaning chamber at a reservoir level and in the second cleaning chamber at an agitation level that is above the reservoir level. The manual cleaning portion may be configured as a sink that is movably connected to the automatic cleaning portion to provide selective access thereto. A first thermal energy source may be used to heat the cleaning solution to a first temperature for the second cleaning chamber and the manual cleaning portion and a second thermal energy source may be used to heat the cleaning solution to a spray temperature greater than the first temperature for the first cleaning chamber. The multipurpose parts washer includes three cleaning portions. All portions use cleaning solution from a single pump, a reservoir portion to collect and store the important volume of cleaning solution and debris from the washing process, a single controller interface operated from a display, and a thermal energy source for heating the cleaning solution.

16 Claims, 8 Drawing Sheets

U.S. PATENT DOCUMENTS

| | | | | |
|---|---|---|---|---|
| 1,889,761 | A | | 12/1932 | Schlesinger |
| 2,579,393 | A | | 12/1951 | Modrey |
| 2,651,311 | A | | 9/1953 | Rule |
| 2,675,012 | A | * | 4/1954 | Scales ..... 134/85 |
| 2,680,802 | A | | 6/1954 | Bremer et al. |
| 3,026,699 | A | | 3/1962 | Rhodes |
| 3,115,145 | A | | 12/1963 | Monteath, Jr. |
| 3,439,689 | A | | 4/1969 | Zadron et al. |
| 3,514,330 | A | | 5/1970 | Schaap et al. |
| 3,659,752 | A | | 5/1972 | Carney, Jr. et al. |
| 3,680,567 | A | * | 8/1972 | Hansen ..... 134/57 D |
| 3,771,772 | A | * | 11/1973 | Honda ..... 366/110 |
| 3,960,728 | A | | 6/1976 | Otzen |
| 4,029,115 | A | | 6/1977 | Wheeler |
| 4,048,121 | A | | 9/1977 | Chang |
| 4,056,114 | A | | 11/1977 | Boutillette |
| 4,103,637 | A | | 8/1978 | Luc |
| 4,125,119 | A | | 11/1978 | Haas |
| 4,128,478 | A | | 12/1978 | Metzger |
| 4,143,669 | A | | 3/1979 | Minkin |
| 4,213,475 | A | | 7/1980 | Minkin |
| 4,261,378 | A | | 4/1981 | Otzen |
| 4,433,698 | A | | 2/1984 | Blaul |
| D275,426 | S | | 9/1984 | Edge |
| 4,543,182 | A | | 9/1985 | Gramse et al. |
| 4,561,903 | A | | 12/1985 | Blaul |
| 4,589,158 | A | | 5/1986 | Sheldon |
| 4,726,388 | A | | 2/1988 | Swinehart et al. |
| 4,741,351 | A | | 5/1988 | Minkin |
| 4,776,359 | A | | 10/1988 | Federighi, Jr. et al. |
| 4,911,190 | A | | 3/1990 | Sheldon |
| D318,098 | S | | 7/1991 | Rizer |
| 5,232,299 | A | | 8/1993 | Hiss |
| 5,303,725 | A | | 4/1994 | Hilgren |
| 5,322,078 | A | | 6/1994 | Tuttle |
| 5,349,708 | A | | 9/1994 | Lee |
| 5,368,053 | A | | 11/1994 | Wilson |
| 5,398,708 | A | | 3/1995 | Sheldon |
| 5,409,308 | A | | 4/1995 | Reuter et al. |
| 5,464,033 | A | | 11/1995 | Hartnell |
| 5,499,643 | A | * | 3/1996 | Vincent et al. ..... 134/104.4 |
| D370,096 | S | | 5/1996 | Niemela et al. |
| 5,528,913 | A | | 6/1996 | Savkar |
| D374,316 | S | | 10/1996 | Niemela et al. |
| 5,580,394 | A | | 12/1996 | Freytag |
| 5,640,981 | A | | 6/1997 | Niemela et al. |
| D393,332 | S | | 4/1998 | Nygren |
| 6,044,852 | A | | 4/2000 | Epperson, Jr. et al. |
| 6,109,277 | A | | 8/2000 | Linton et al. |
| 6,115,541 | A | | 9/2000 | Rhodes |
| 6,124,253 | A | | 9/2000 | Vinci et al. |
| 6,199,565 | B1 | | 3/2001 | Bluestone |
| 6,306,221 | B1 | | 10/2001 | Magliocca |
| 7,128,075 | B2 | | 10/2006 | Publ |
| 7,484,515 | B1 | | 2/2009 | Bluestone et al. |
| 2005/0000553 | A1 | | 1/2005 | Noguchi et al. |
| 2005/0199267 | A1 | | 9/2005 | Oakes |
| 2005/0268949 | A1 | | 12/2005 | Rosa |

OTHER PUBLICATIONS

ADF Systems, Ltd.; Parts Washers model 300 series brochure; Apr. 1992; entire brochure.

ADF Systems, Ltd.; Accessories Oil-Water Separator brochure; Oct. 1991; entire brochure.

ADF Systems, Ltd.; Parts Washers model 10 brochure; entire brochure.

ADF Systems, Ltd.; Parts Washers Series 700/800/850 brochure; Feb. 1992; entire brochure.

American Metal Wash, Inc.; Industrial Parts Cleaning Equipment brochure; entire brochure.

Better Engineering Mfg., Inc.; Custom Washers brochure; entire brochure.

Blaser Swisslube, Inc.; Oil Skimmer brochure; Oct. 1989; entire brochure.

Clean Tech Magazine; Cuda Unit advertisement; Jan. 2002, p. 22.

IMPO Magazine; Product Round-up; Cleaning Equipment; Sep. 2002, p. 13.

Insta-Clean, Inc.; Insta-Clean Model IC-3 brochure; entire brochure.

Insta-Clean, Inc.; 3 in 1 Parts Washer brochure; entire brochure.

Intercont Products, Inc.; Spray Washers/Cabinet brochure; entire brochure.

Intercont Products, Inc.; Fluid Line Flushers flyer; entire flyer.

Intercont Products, Inc.; Automated valve body & small parts flyer; entire flyer.

Intercont Products, Inc.; Parts Tumbling Machine brochure; entire brochure.

Intercont Products, Inc.; Model EQAS 1000 flyer; entire flyer.

Intercont Products, Inc.; Rear Wheel Drive Transmission Test Machine flyer; entire flyer.

Intercont Products, Inc.; Walker Washer Model 4872-2 brochure; entire brochure.

Intercont Products, Inc.; Front Loading Spray Washers brochure; entire brochure.

Intercont Products, Inc.; Conveyor Washer Specifications; entire specifications.

Intercont Products, Inc.; Combination Transmission Test Machine brochure; entire brochure.

Intercont Products, Inc.; Front Wheel Drive Transmission Test Machine flyer; entire flyer.

Intercont Products, Inc.; Torque Converter Flusher Model TCF-1 flyer; entire flyer.

Intercont Products, Inc.; Lock Up Torque Converter Tester Model TCT flyer; entire flyer.

Intercont Products, Inc.; Parts Cleaner Model ST-1/ST-2 flyer; entire flyer.

Kärcher Parts Washers; Cuda Series Front-Load Automatic Parts Washers brochure; Jan. 2007; entire brochure.

KleenTec, Inc.; Aqueous Parts Washer brochure; entire brochure.

Mega-Mate Parts Washers catalog; Environmental Parts Washer Specifications; Jan. 1, 1998 through Mar. 31 1998; p. 36.

The Hotsy Corporation; Tub Parts Washers brochure; entire brochure.

Intercont Products Inc., flyer entitled "Intercont is Already There".

European Patent Office, Extended Search Report, Jun. 30, 2008, pp. 1-9, Rijswijk, Netherlands.

U.S. Patent and Trademark Office, ISA, International Search Report and Written Opinion of the International Searching Authority, International Application No. PCT/US20091041986, Jun. 18, 2009.

* cited by examiner

MULTIPURPOSE AQUEOUS PARTS WASHER

FIELD OF THE DISCLOSURE

The present disclosure relates generally to a multipurpose aqueous parts washer used to wash grease, oil, dirt, or other debris from mechanical parts, and more particularly, to a parts washer having a housing with an automatic spray-washing portion, a soak-washing portion, and a manual sink washing portion for cleaning parts.

BACKGROUND

The present disclosure relates to an apparatus for washing mechanical parts using a multipurpose aqueous parts washer. Mechanical parts collect dirt, abrasion residue, used grease, or other debris during normal operation. During periodic maintenance, extraordinary maintenance, repairs, or even scheduled upgrades, mechanics disassemble parts from a larger mechanical element, such as a car engine. Individual parts and subassemblies must be washed before they are either thrown away, diagnosed, or eventually reinstalled in the mechanical device or before they are reconditioned for further use.

A parts washer is an apparatus that cleans parts, either individually or in groups of parts, including but not limited to machinery and machine parts. Parts washers can also clean elements such as chains, tools, or other elements susceptible to contact with greased or oiled parts. These cabinet-size devices are an essential tool for any mechanic or other worker having to clean parts in a workshop. For example, automobile mechanics place parts washers alongside tools or next to their work area.

The core technology associated with parts washers is not unlike the technology associated with the cleaning of kitchen utensils and other food preparation accessories, the significant difference being that mechanical parts washer residue must be controlled before the effluents are released into the environment. Therefore, a different cleaning solutions must often be used, parts are generally washed infrequently once dirt is dried, oil-based effluents must be collected and confined, insoluble debris must be collected and filtered as sludge, and cleaning solutions are regenerated. The workshop environment in which the parts washers are used also differs. Some parts washers use an aqueous cleaning solution to dissolve and remove grease, carbon, resins, tar, inks, and other debris. These parts washers use water, soap, and/or detergents, common or proprietary. Other more aggressive parts washers use hydrocarbon-based solvents or other solvents to degrease and wash parts. What is contemplated by this disclosure is a parts washer using any type of cleaning solution, but more preferably a parts washer using an aqueous-based cleaning solution.

Parts washers are generally stored where parts are removed or processed for convenient use. Confined spaces and other constraints associated with workshops warrant compact and portable devices. Parts washers must also be robust and durable under strenuous environments. Four different technologies are know in the industry: manual parts washing, automatic parts washing, spray spray-under immersion cleaning, and soaked parts washing. Manual parts washers generally resemble a sink positioned over a reservoir holding a cleaning fluid. An operator of the manual parts washer may push a pedal or take another action to activate a pump and heating element located within the reservoir to circulate cleaning fluid. The advantages of manual parts washers are numerous. For instance, they allow for tactile recognition of fine layers of dirt, the focus of cleaning efforts at a specific location, and cleaning conducted immediately by the operator.

Automatic parts washers normally consist of a housing holding some basket for storage and removal of parts within the housing. Automatic devices have large access doors, a control apparatus for programming spraying cycles, and pumps/heaters for activating the cleaning solution within the device. The advantages of automatic parts washers over manual parts washers includes time saving, the capacity to store dirty parts within the enclosure between washes, parts washing during off-hours, the capacity to utilize pressures and temperatures outside of the human comfort zones, and most importantly, the reduction of the need for the operator to dirty his hands during the washing operation. Other technologies used to wash parts include soaking, where parts are immersed in a volume placed within a constant, regenerated flow of cleaning solution or with a series of immersed sprays within the regenerated flow. These washers allow for the slow removal of attached dirt by using a relatively low quantity of cleaning fluid.

Each of these different technologies has distinct advantages and disadvantages. Different washers are currently needed if different advantages are desired since the management of parts, cleaning solutions, debris, and sludge differs greatly between these devices. What is needed is a device capable of offering the advantages associated with each of these technologies within a single apparatus capable of handling the constraints associated with these types of washers. What is also needed is a series of operative and functional improvements associated with the use of a single device with multiple washing solutions.

SUMMARY

One aspect of the present disclosure relates generally to a multipurpose parts washer used to remove grease, oil, and dirt from mechanical parts, and more particularly, to an apparatus for washing parts within a single housing having an automatic cleaning portion, with a first cleaning chamber for spraying parts, a second cleaning chamber for soaking parts, and a manual cleaning portion. The multipurpose parts washer may include three cleaning portions, all portions provided cleaning solution by a single pump, a reservoir portion to collect and store an important volume of cleaning solution and debris from the washing process, a single controller interface operated from a display, and a thermal energy source for heating the cleaning solution. The multipurpose design may also include other novel features such as the use of a submerged pump within the reservoir, easy-access panels for the pump motor, the controller, and the display, an integrated sink serving as a lid of the automatic portion to collect the cleaning solution of the manual cleaning portion and to enclose the automatic cleaning portion, and the use of a timer and a multicolor display for easy operation of each of the cleaning portions.

BRIEF DESCRIPTION OF THE DRAWINGS

The following disclosure as a whole may be best understood by reference to the provided detailed description when read in conjunction with the accompanying drawings, drawing description, summary, abstract, background of the disclosure, field of the disclosure, and associated headings. Identical reference numerals when found on different figures identify the same elements or a functionally equivalent element. The elements listed in the summary and abstract are not referenced but nevertheless refer by association to the elements of the detailed description and associated disclosure.

DETAILED DESCRIPTION

Figure 1:
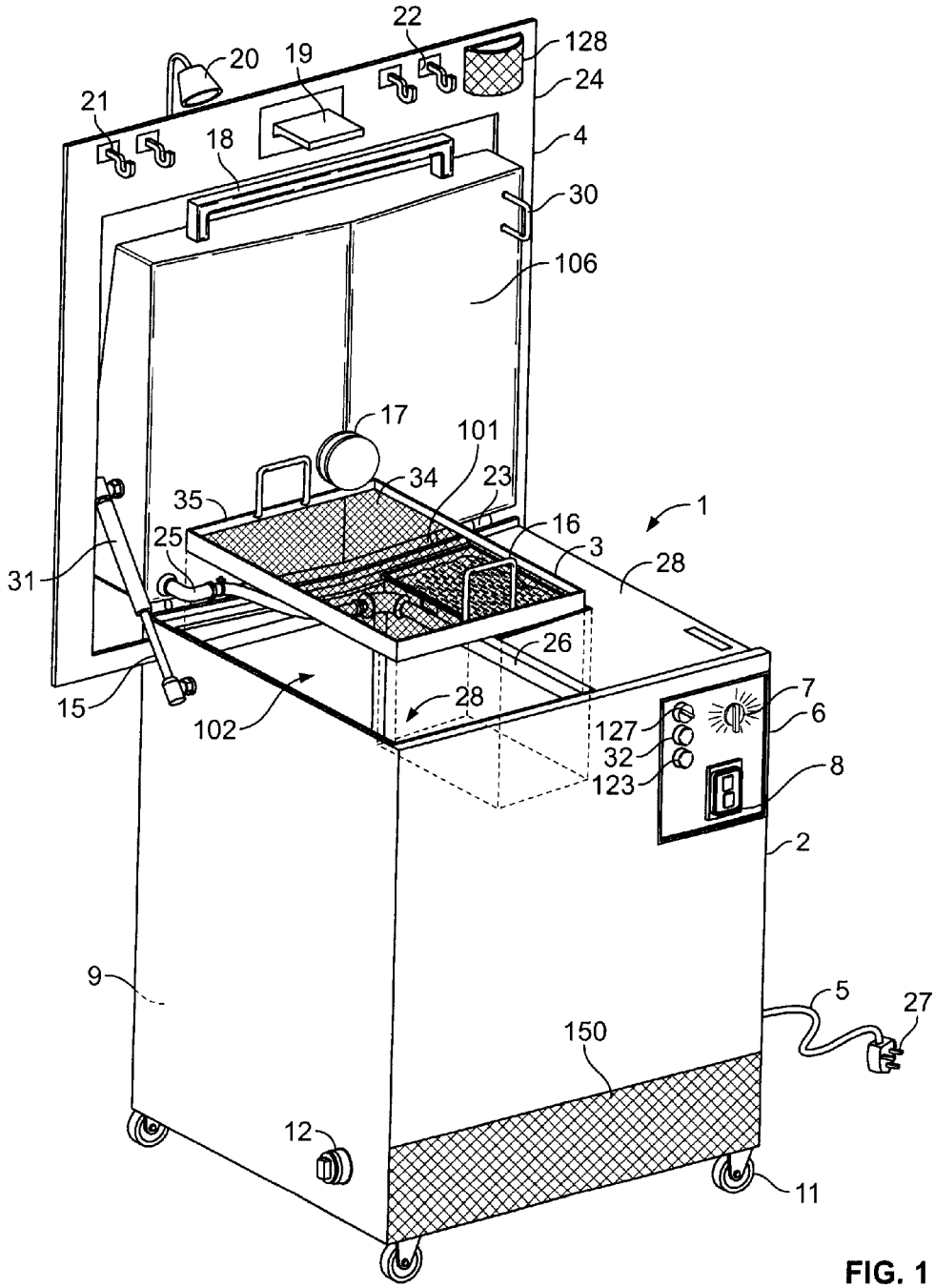
FIG. 1 is a partly exploded perspective view of the multipurpose aqueous parts washer in accordance with an embodiment of the present disclosure with the manual cleaning portion in an open configuration and where the pull-out rack is shown partially removed.

FIG. 1 is a partly exploded perspective view of the multipurpose aqueous parts washer in accordance with one embodiment of the present disclosure with a manual cleaning portion in an open configuration and where a pull-out rack is shown partially removed. FIG. 1 shows an apparatus for washing parts 1 having an automatic cleaning portion 2 defined by a first cleaning chamber 102 and a second cleaning chamber 101. The apparatus for washing parts 1 in one embodiment includes a manual cleaning portion 103 movably connected to the automatic cleaning portion 2 by a series of pivoting points 23.

The apparatus for washing parts 1 in one embodiment includes two different washing chambers 101, 102 and a cleaning portion 103 that can each be operated by an operator when faced with different washing needs. Each chamber or portion 101, 102, and 103 preferably shares a cleaning solution 100 common to each chamber or portion 101, 102, and 103 and collected in a single reservoir portion 36. It is understood by one of ordinary skill in the art that while three distinct chambers or portions 101, 102, 103 are shown in a certain spatial distribution, what is contemplated is the use of chambers and portions arranged in any spatial configuration. For example, one of ordinary skill in the art recognizes that while the apparatus for washing parts 1 is shown as a vertically stacked cabinet in a shape close to that of a shop tool box, the apparatus for washing parts 1 can be placed in numerous other locations having different spatial constraints, including but not limited to the need to attach the device to a ceiling, a top ledge, a bottom ledge, or installed in a countertop or work benches, or inserted in a portion of a vehicle, inside a sliding or rotating door, on a tool storage device, or even outside of a maintenance vehicle. For each of these and other uses, what is contemplated is the displacement and reorientation of the chambers and portion 101, 102, and 103 in a wide variety of possible configurations that do not alter this disclosure. What is also contemplated is the use of different sizes and geometries of each chamber or portion 101, 102, and 103 based on the different needs in the marketplace associated with a particular model of apparatus for washing parts 1. As an example related to the embodiment shown in FIGS. 1-8, if this disclosure is adapted to the undercarriage of a moving maintenance vehicle of a speed car crew having specific needs for soaked washing of large parts, a larger second chamber 101 may be placed along the side the first chamber 102 of equivalent size and shape as the first chamber, and the manual cleaning portion 103 can be located above one or both of the chambers 101, 102.

Figure 5:
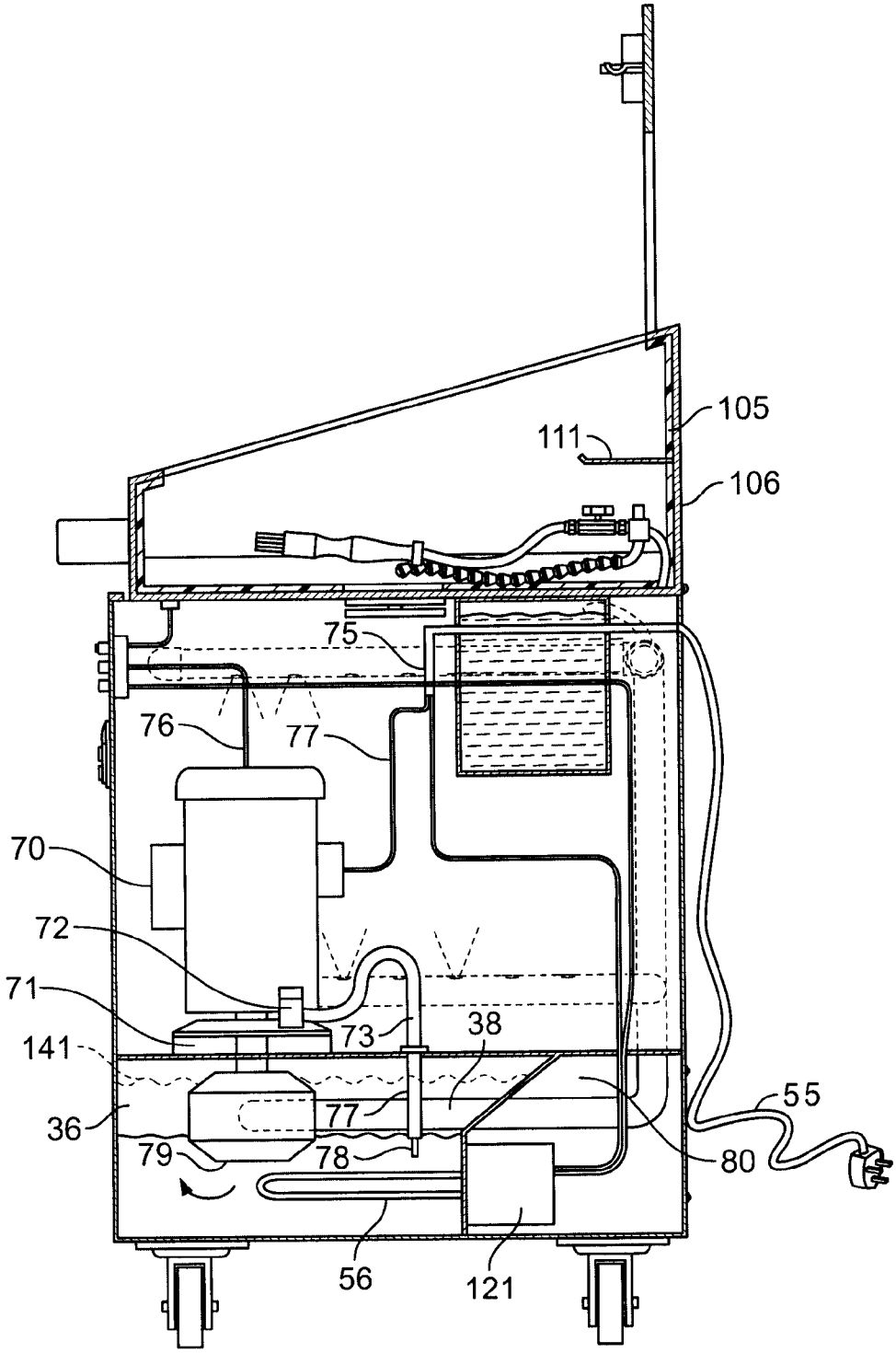
FIG. 5 is a side elevation of the multipurpose aqueous parts washer of FIG. 1 in the configuration and as shown in FIG. 2 along line 5-5.

In one embodiment shown in FIG. 1, the manual cleaning portion 103 is defined by a basin 104 preferably made of a folded or bent sheet of metal 106, which is best illustrated in FIG. 5, having a resistant polymer or vinyl coating 105 placed above the sheet of metal 106. In one embodiment, for easy removal and replacement, the polymer coating 105 is not attached to the sheet of metal 106 but is held in place around the edges and drain 46. It is understood by one of ordinary skill in the art is that the coating 105 above the sheet of metal 106 serves as a mechanical protector and chemical protector, the coating 105 can be removed or replaced by any other suitable laminated protector, including but not limited to paint, surface coating, or even the removal of the polymer coating 105 and replaced by a sheet of metal 106 having a surface like polished glass. It is also understood by one of ordinary skill in the art is the use of any other type of protector designed to withstand the shocks associated from placing parts to be washed within the basin 104 and capable of chemically withstanding any abrasion, corrosion, or degradation associated with the cleaning solution 100 used in the apparatus 1.

In one embodiment, the sheet of metal 106 may be made of a plate 47 folded in an open U shape or a V shape with gently sloping side walls placed in opposition to V-shaped end walls 45 to collect the effluents by gravity within the basin 104. The basin 104 may also include a series of inwardly rolled lips 129 placed on the external periphery of the basin 104 to limit and control splashing. While inwardly rolled lips 129 are shown, what is contemplated is the use of any geometry on the outer periphery of the basin 104 or the use of a guard, splashguard, or protection locked into place to offer any similar protection to the operator. What is also contemplated is the use of mats, tissues, or other materials at the bottom of the sink 104 that are designed to prevent splashing.

Figure 2:
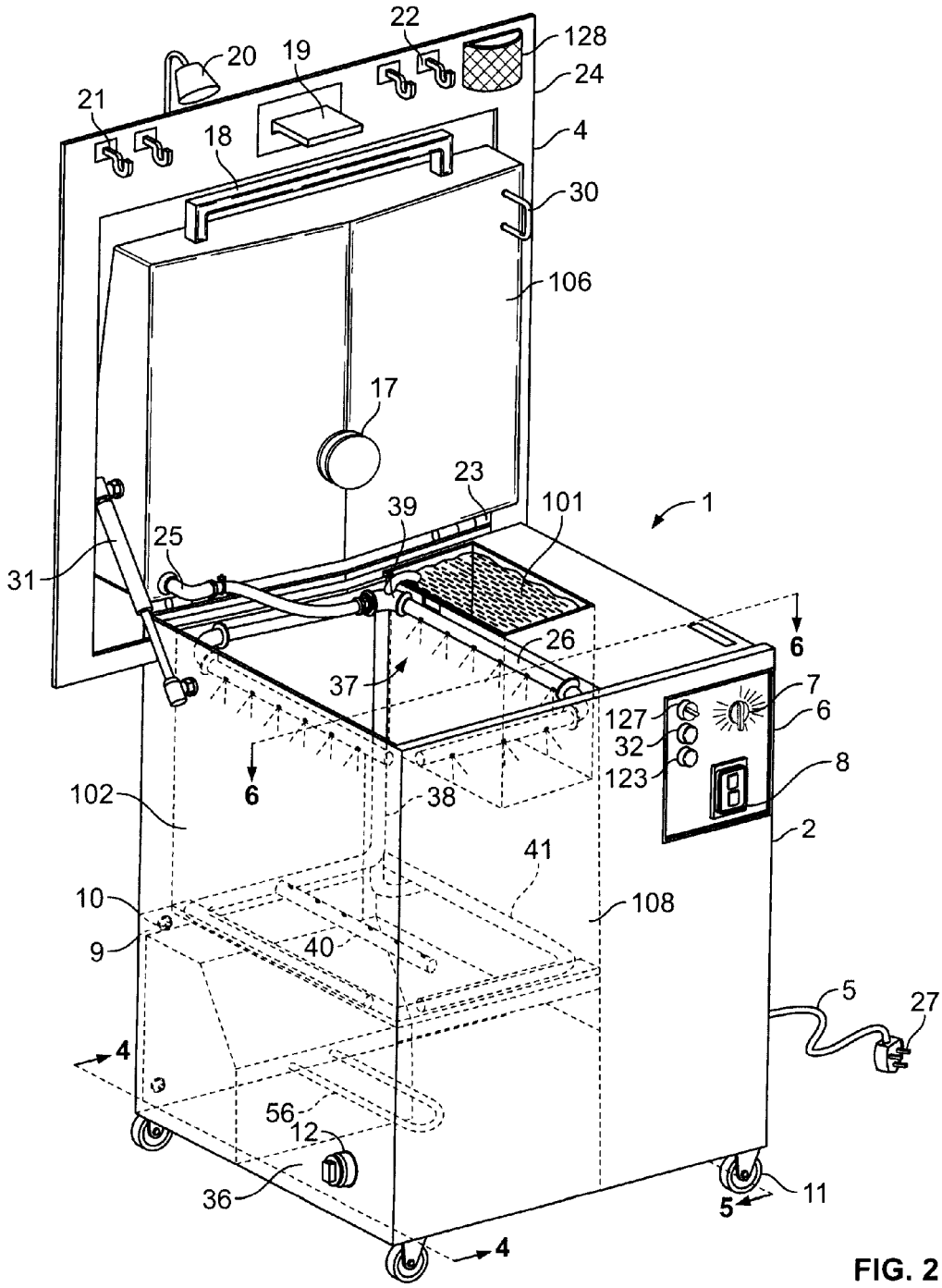
FIG. 2 is a perspective view of the multipurpose aqueous parts washer of FIG. 1 without the pull-out rack with internal portions shown by transparency and with cleaning solution within the soaking tank.
Figure 3:
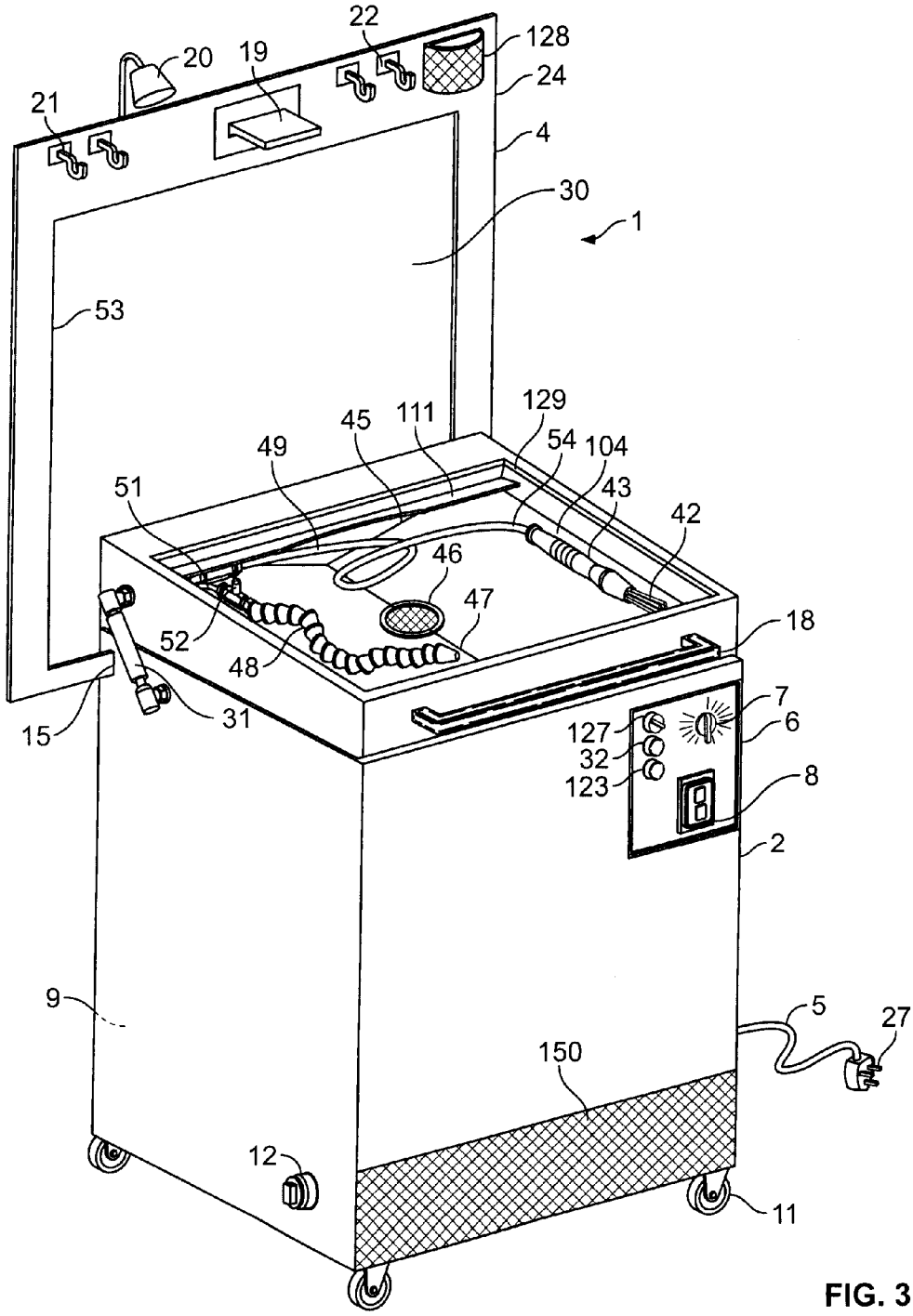
FIG. 3 is a perspective view of the multipurpose aqueous parts washer of FIG. 1 with the manual cleaning portion in a closed configuration.
Figure 8:
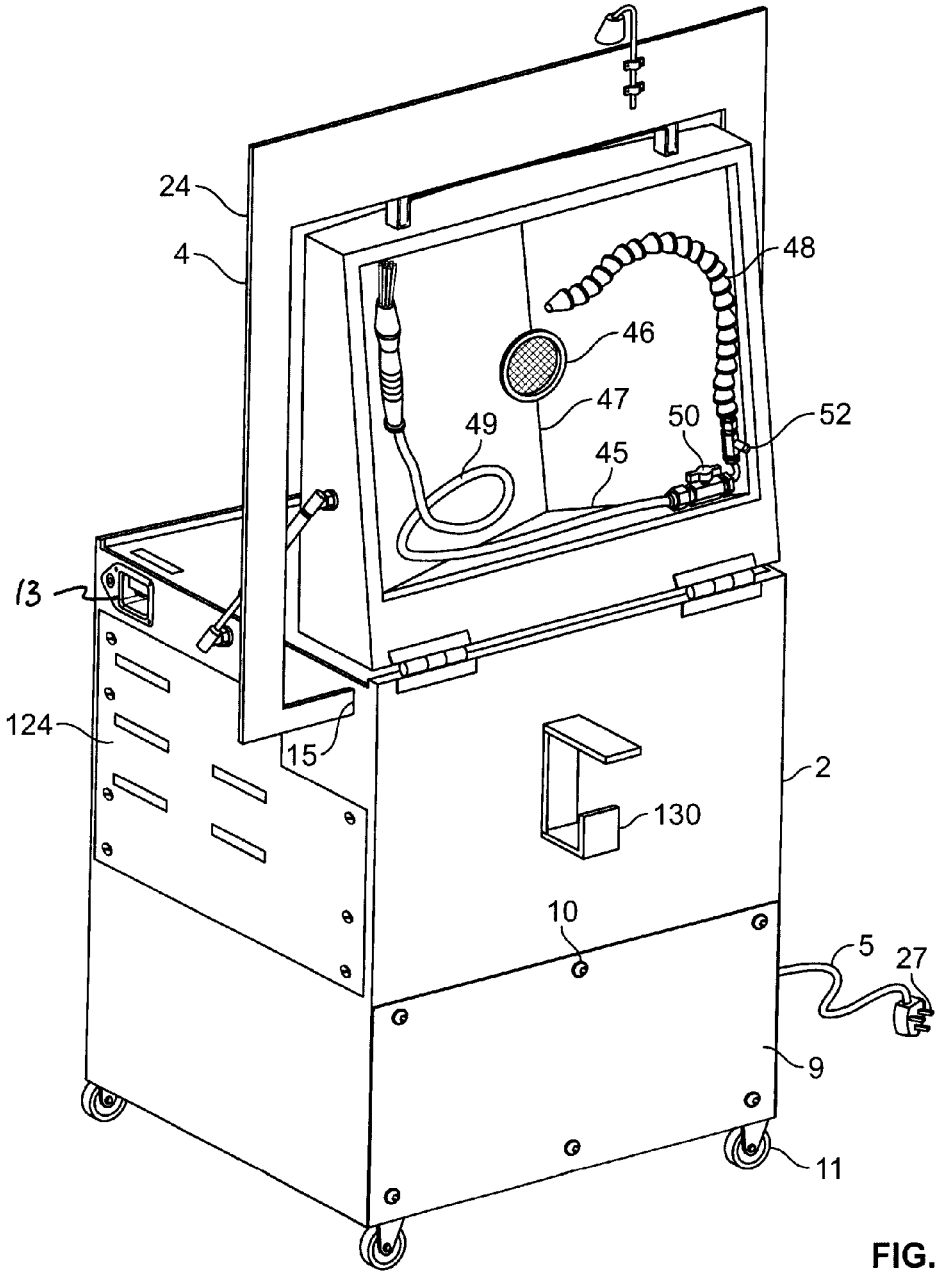
FIG. 8 is a back perspective view of the multipurpose aqueous parts washer as shown in FIG. 1.

FIG. 3 illustrates a bottom drain 46 on the bottom part of the sheet of metal 106. The drain 46 allows for the transfer of a cleaning solution 100 sprayed within the basin 104 and collection through the drain 46 down into the first cleaning chamber 102. A cleaning fluid 100 used in the apparatus 1 is released by a fluid distribution device 49 manually operated directly or with the help of tools and gloves by an operator. FIGS. 3 and 8 show a bottom drain 46 having a first possible center strain 110. FIGS. 1-2 and 4-5 show the lower side of the bottom drain 46. A anti-backsplash plate 17 shown in one disclosed embodiment as a plate attached by a vertical pole at a small distance from the bottom section of the drain 46. The anti-backsplash plate 17 serves to prevent the cleaning fluid 100 from passing from the first cleaning chamber 102 to the basin 104. While one type of device is shown as an anti-backsplash plate 17, what is contemplated is the use of any flow displacement system capable of preventing the cleaning fluid 100 from moving up back to the basin 104 during operation of the first cleaning chamber 101.

In another embodiment, the bottom surface of the basin 104 forms a lid 106 to close the first cleaning chamber 102 when the lid 106 is disposed in a closed position as shown in FIG. 3. The lid 106 can also rotate via a pivoting point 23 to an open position as shown in FIG. 1 to allow access into the first cleaning chamber 102. In one embodiment, the basin 104 may be held in the open configuration by two lateral pistons 31 made of two interconnected sections attached on the external surface of the automatic cleaning area 2 and the basin 104. FIG. 1 shows the pistons 31 in an extended position, whereas FIG. 3 shows the pistons 31 in a retracted position. One of ordinary skill in the art understands that while one type of holding device is shown, what is contemplated is the use of any locking or nonlocking holding device capable of operating the basin 104 between an open position and a closed position shown in FIGS. 1 and 3, respectively.

FIG. 8 also shows a locking device 13 on the automatic cleaning area 2 operating in tandem with element 30 as shown on FIG. 1 to lock the basin 104 serving as a lid 106 into the closed configuration as shown in FIG. 3. A mechanical proximity detector (not shown) operating with or without a counterpart surface allows the control system (described fully hereinafter) to recognize if the lid 106 is open, closed, or ajar. In one embodiment, the detector is part of the locking device 13. In one contemplated embodiment, the control system turns off any operating cycle or flow from the pump 79 to prevent any spraying or splashing of the operator with cleaning solution 100 if the lid 106 is in the open position. One of ordinary skill in the art recognizes that while one type of proximity detector is placed within the locking device 13, any type of proximity sensor is contemplated, including but not limited to a bending detector placed within the hinges 23 in the back of the lid 106, a laser detector, a surface detector placed on the top of the automatic cleaning portion 2, a mechanical detector where an insert on the bottom surface of the lid 106 enters the first cleaning chamber 102, or the like. What is also contemplated is the use of any other type of locking mechanism 13, 30 designed to secure the basin 104 onto the automatic cleaning area 2 in any potential configuration of basin 104, lid 106, or automatic cleaning area 2, including but not limited to a locking mechanism within the two lateral pistons 31.

FIG. 1 shows an apparatus having a wall protection plate 4 designed to house the basin 104 when in open configuration but also to hold different tools and useful items when the operator is washing parts in the manual cleaning portion 103. What is contemplated is the use of a series of hooks 21, 22, lamps 20, board holders 19, or net holders 128 placed on the front face 24 of the wall protection plate 4. The object of the different components placed upon the wall protection plate 4 is to provide ease of use and operation to an operator of the apparatus 1 during the different phases of operation. FIG. 1 shows a wall protection plate 4 attached 15 on both sides of the automatic cleaning area 2.

What is also shown is the use of rollers 11 or wheels placed under the automatic cleaning area 2 to provide the apparatus 1 with horizontal mobility. What is also contemplated (but not shown) is the use of manually locking wheels or coasters to stabilize the apparatus 1 at a specific location. What is also disclosed (but not shown) is the use of stabilizing weights, used as a counter-balance or to reduce any ensuing waves created within the reservoir portion 36 in the cleaning solution 100 by moving elements placed within the automatic cleaning area 2. Other vibration-reducing techniques, such as the use of ballasts (not shown) within the reservoir portion 36, are equally contemplated and disclosed herein to reduce movement caused within the reservoir portion 36 due to moving elements or pumping effects 79 during the rotation of an internal moving element.

Figure 4:
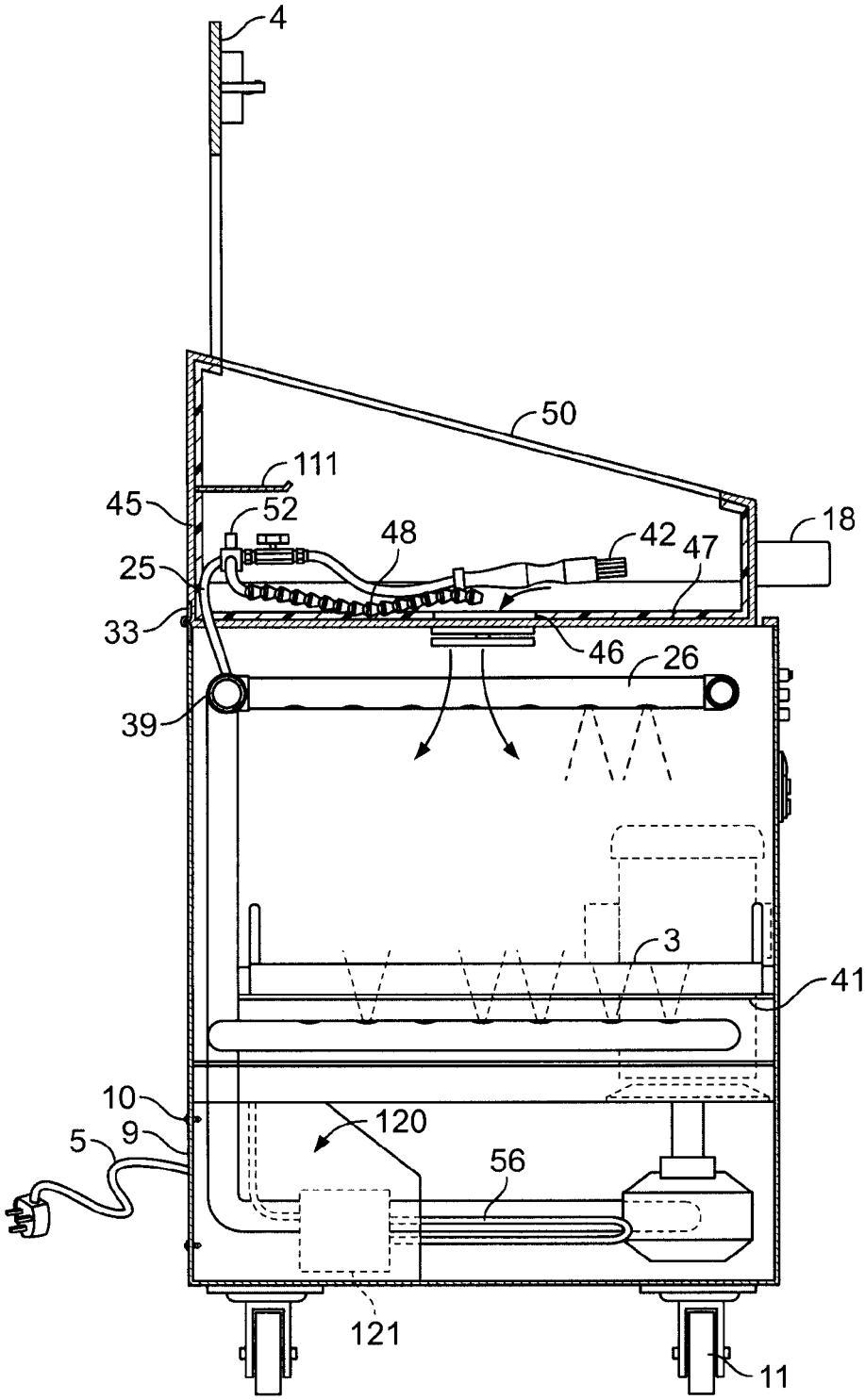
FIG. 4 is a side elevation of the multipurpose aqueous parts washer of FIG. 1 in the configuration and as shown in FIG. 3 along line 4-4.

What is also contemplated is the use within the basin 104 of holding and storage surfaces 111 as shown in FIG. 4 to aid an operator and allow for flow of cleaning solution 100 from the parts once the parts washed and placed on the storage surfaces 111. In one embodiment, the storage surface 111 is made of perforated metal and is attached to the V-shaped end walls 45. While one possible type of storage surface 111 is shown, what is contemplated is any type of ledge, ridge, pole, axis, support, or the like capable of serving as a resting place for parts washed in the basin 104. The basin 104 also further comprises a handle 18 or a grasping mechanism designed to allow the operator to move the basin 104 from a first configuration to a second configuration (both configurations shown in FIGS. 1 and 3). The basin 104 as shown on the left and right side elevation views of FIGS. 4-5 has a front angle 50 forming a higher back wall than a front wall where the handle 18 is located in the front of the basin 104. One of ordinary skill in the art recognizes that such geometric constructions, such as those shown in the disclosed possible embodiments, are functionally useful but in no way limit the scope of what is contemplated and can be adapted based on functional requirements of any specific type of apparatus for washing parts 1.

In one possible embodiment, the fluid distribution device 49 located in the basin 104 is supported on the bottom side of the basin 104 by a U-shaped connector 25 on a hose as shown in FIG. 1. The hose is, in one embodiment, split into two parallel sections 54, 107, each including a manual control valve 51, 52 upstream of the sections 54, 107, respectively, each having downstream a manual cleaning tool such as a quick-connect hose 48 or a flow-thru brush 43 designed with a brush ending 42. The manual cleaning portion 103 is operated by an operator by placing a mechanical part to be washed inside of the basin 104 and then holding with a hand either one of the sections 54, 107 and the associated manual cleaning tool and opening the manual control valve 51, 52 associated with the section 54, 107 held by the operator to direct the flow of cleaning solution 100 onto the part. The manual control valve 51, 52 as shown is a manually activated flow regulator. While manual control valves 51, 52 are shown, what is contemplated is the use of any flow control device, either manual or electronically controlled to maintain the flow at appropriate speeds and pressures for parts washing. What is also contemplated is the use of pulsating flow.

FIG. 2 shows in partially transparent view the first cleaning chamber 102 having a spray portion 108 located above a reservoir portion 36. The reservoir portion 36 is configured to store and collect a cleaning solution 100 and collect debris. The spray portion includes a parts support 41 shown in FIG. 7 and a spray bar 38 shown with at least one orifice 37 for distributing the cleaning solution 100 on the parts (not shown). The spray bar 38 as shown in FIG. 2 is shaped with a top level 26 and a bottom level 40 each having orifices 37 oriented toward the central portion of the spray portion 108 to spray any parts placed within the portion. The spray bar 38 also includes a vertical section situated between the top level 26 and the bottom level 40.

Figure 7:
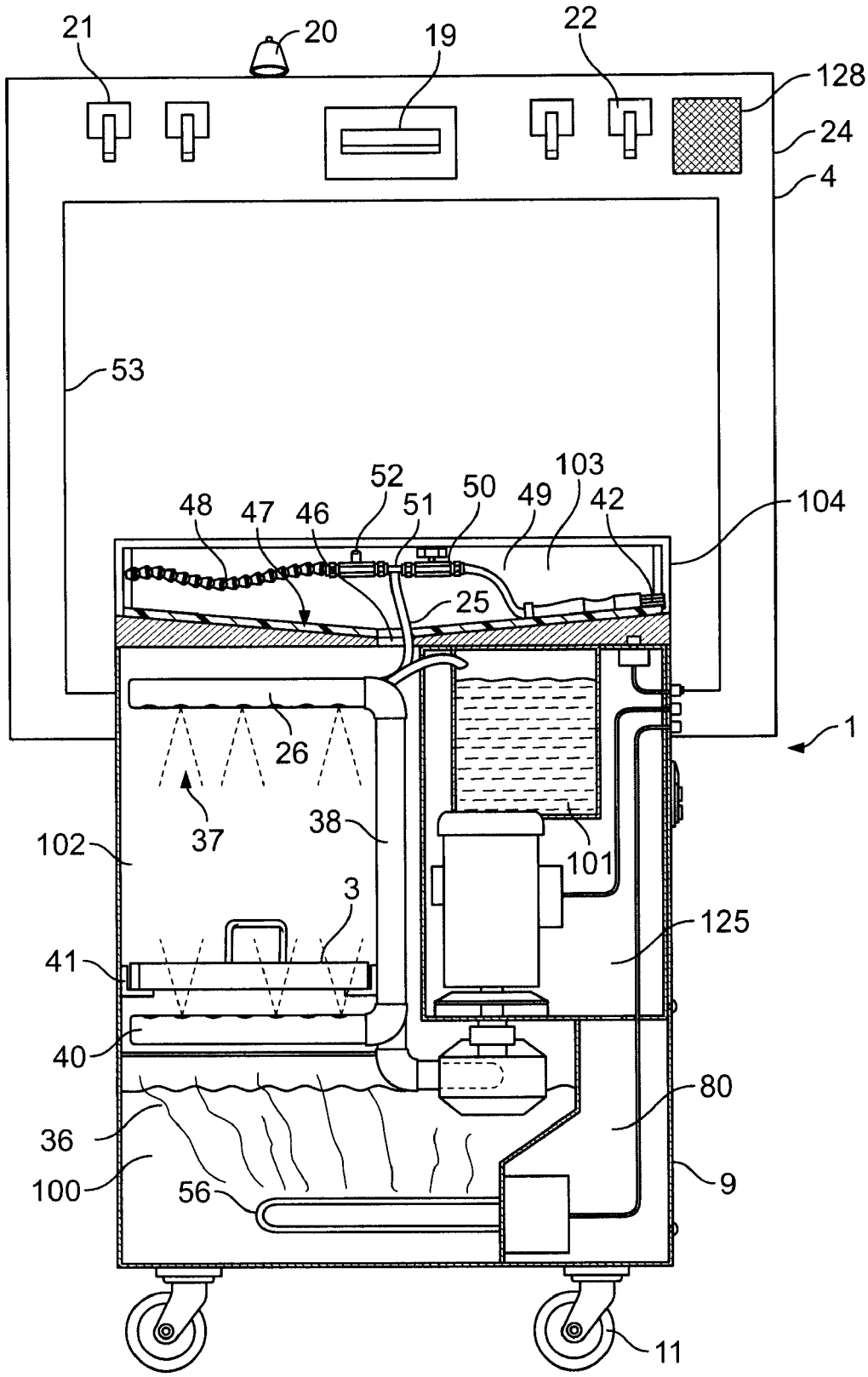
FIG. 7 is a schematic representation of the different elements within the multipurpose aqueous parts washer of FIG. 1 in the closed configuration.

A secondary bar is shown in FIG. 2 as a possible configuration of orifice 37 distribution. FIG. 7 shows small jets of cleaning solution 100 as dashed lines emanating from both the bottom level 40 and the top level 26 onto the spray portion 108. FIG. 7 illustrates the pull-out rack 7 shown in perspective view in FIG. 1 in the form of a rack with handles 16 with edges 35 placed in the spray portion 108 and having a center grid-like mesh 34. A part (not shown) placed within the spray portion 108 is sprayed by cleaning solution 100 from the top and the bottom. The spray bar 38 includes a first portion disposed adjacent to the parts support and the bottom level 40 and a second portion disposed adjacent to a top end and the top level 26 of the spray portion.

What is contemplated is the use of orifices, pipes, and supports of different size, configurations, and orientation to enable a part to be adequately washed based on the washing conditions, such as but not limited to temperature, pressure, flow, and diluting capacity of the cleaning solution 100. What is also contemplated is the use of grates fixed directly to the side walls within the spray portion 108 to for horizontal support and to hold parts in the apparatus 1. One of ordinary skill in the recognizes that while a rectangular geometry of the spray portion 108 is shown, what is contemplated is a spray portion 108 of any geometry. What is also contemplated is the use of hooks, cables, rails, edges, or plates that may be used to hold parts within the apparatus 1 or to hold other parts or racks.

The second cleaning chamber 101 in one embodiment may be a soaking tank of rectangular geometry designed to hold mechanical parts to be washed. In one contemplated embodiment, a series of sprays operating in the cleaning solution 100 can be added to provide additional washing within the soaking tank. A connector 39 shown in FIG. 2 is in fluid communication with the spray bar 38 and allows for a flow of cleaning solution 100 within the second cleaning chamber 101. In one embodiment, the flow is continuous and allows for surface regeneration of the cleaning solution 100 within the soaking tank by creating a constant overflow of the cleaning solution 100 back into the reservoir portion 36 in order to dilute any suspended particles of debris in the cleaning solution 100. One of ordinary skill in the art will recognize that other methods are contemplated to conduct flow regeneration within the second cleaning chamber 101 such as a drain valve at the bottom of the soaking tank, a pressure-sensitive control flow valve acting as a bottom drain calibrated to maintain the level of cleaning fluid 100 within the soaking tank, the use of a removable container such as a basket or the like for pouring the cleaning solution back into the reservoir portion 36. A notch 247 as shown on FIG. 2 can be used to facilitate the flow from the second cleaning chamber 101 to the first cleaning chamber 102.

The second cleaning chamber 101 as shown is placed adjacent to the first cleaning chamber 102 with a top opening in communication with the top surface of the automatic cleaning portion 2. This allows easy access by an operator simply by placing the lid 106 in the open configuration by holding the handle 18 and accessing both the first cleaning chamber 102 and the second cleaning chamber 101. While one possible method of access is shown, what is contemplated is the placement of the second cleaning chamber 101 at any judicious position within the automatic cleaning portion 2, including but not limited to the placement within a rack, a protuberance, an enclosure, or other bodies that may be placed in fluid communication with the first cleaning chamber 102. What is also contemplated is the use of baskets, slow-acting brushes, or other moving parts to improve the cleaning capacity of the soaking tank. What is also contemplated is the use of other means of cleaning within the second cleaning chamber, including but not limited to ultrasonic cleaning. FIG. 1 also discloses the use of a bottom drain 12 used to drain the reservoir section 36 during maintenance.

Figure 6:
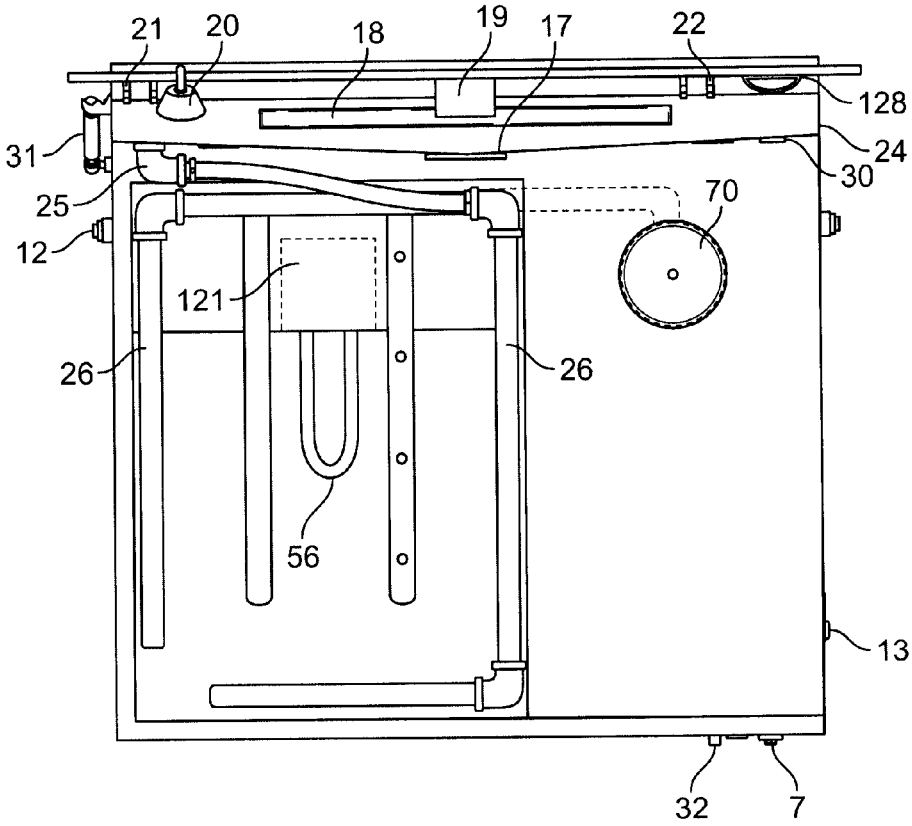
FIG. 6 is a top view of the multipurpose aqueous parts washer of FIG. 1 in an open configuration.

The apparatus for washing parts 1 further includes a thermal energy source 120 having an element section 56 and a control section 121 disposed in the reservoir portion 36 contiguous with the cleaning solution 100 for controlling the temperature of the cleaning solution 100. Because a single cleaning solution 100 is used throughout the apparatus for washing parts 1, the cleaning solution 100 is heated to operating temperatures by a single element section 56 located in the reservoir portion 36. In one embodiment, the fluid is heated to a range of 120° F. to 125° F. FIG. 8 shows the use of a back door 9 attached using a fixation means 10 such as screws or bolts to provide access to the control section 121 of the thermal energy source 120. FIG. 6 shows the compartment 80 created to house the control section 121 of the thermal energy source 120. In yet another embodiment, what is contemplated is the use of a thermal energy source 120 made of a single block that can be placed within the reservoir portion 36 to heat the cleaning solution 100 locally or in a close proximity to the inlet of the pump 79. In this embodiment, the reservoir portion 36 can be increased in size by removing the compartment 80. What is not disclosed but is known by one of ordinary skill in the art is the use of a thermal junction having leak-proof seals between the compartment 80 and the reservoir portion 36. In one embodiment, the heating is activated and controlled by placing the surface temperature of the element section 56 in close proximity to the equilibrium temperature of the cleaning solution 100.

What is also contemplated is the use of a thermal sensor (not shown) placed in communication with the cleaning solution 100 to regulate the temperature of the cleaning solution 100 by alternatively energizing and turning off the thermal energy source 120. In yet another embodiment, the regulation of the temperature is selected the operator on the display 6 using a temperature selection knob (not shown). While one possible temperature control device is shown, what is contemplated is the use of any method of thermal regulation of the cleaning solution 100 either in a single source, a diffuse source, or a plurality of sources. What is also contemplated is the possible calibration of the heating source 120 to other operating and equilibrium temperatures based on the optimal temperature of the cleaning solution 100. What is also contemplated is the use of two different energy sources, the first to heat the cleaning solution 100 to a first operating temperature based on the optimal operating temperature during a manual washing operation and a second heating source heating the cleaning solution locally before it is sprayed onto parts located within the spray portion 108. In one embodiment, an inclined wall is placed on the separation wall between the compartment 80 and the reservoir portion 36.

The apparatus for washing parts 1 also includes a pump 79 placed in fluid communication with the cleaning fluid 100 in the reservoir portion 36. FIG. 5 shows the pump 79 as having a fixation plate 71 and a motor 70 for energizing the pump 79. In one embodiment, the pump 79 is disposed in the reservoir portion 36 and is in fluid communication with the spray bar 38, the soaking tank 101, and the fluid distribution device 49 for circulating the cleaning solution 100 from the reservoir portion 36 to at least one of the soaking tank 101, the fluid distribution device 49, or the spray bar 38. The pump motor 70 is placed in an enclosure 125 protected by a side door 124 as shown in FIG. 8. The pump 79 pushes cleaning fluid 100 to the other sections of the apparatus for washing parts 1. In one embodiment, the reservoir portion 36 has a capacity of up to 20 gallons.

The apparatus for washing parts 1 also includes a control system 200 for controlling the device described above, and more specifically, an automatic cleaning portion 2 defined by a first cleaning chamber 102 including a spray portion 108 and a reservoir portion 36, the spray portion 38 having a parts support 41, and a spray bar 38 with at least one orifice for distributing a cleaning solution 100 onto the parts (not shown), the reservoir portion 36 configured to store and collect the cleaning solution 100. The manual cleaning portion 103 is movably connected via a pivoting point 23 to the automatic cleaning portion 2 and is defined by a basin 104 including a drain 46 and a fluid distribution device 49, wherein the fluid distribution device 49 discharges the cleaning solution 100 into the basin 104 for collection through the drain 46 into the first cleaning chamber 102, and a plug 5 adapted for electrical connection 27 to an external power supply for energizing a controller 201 for selectively activating at least a timer 7 in the automatic cleaning portion 2, a proximity detector (not shown) between the automatic cleaning portion 2 and the manual cleaning portion 103, a thermal energy source 56 in contact with the cleaning fluid 100 in the reservoir portion 36, a pump 79 disposed in the reservoir portion 36 in fluidic communication with the spray bar 38 and the fluid distribution device 49 for circulating the cleaning solution 100 from the reservoir portion 36 to at least one of the fluid distribution device 49 or the spray bar 38. The controller 201 further energizes a first display 32 when the pump 79 is energized, energizes a second display 124 when the cleaning fluid falls below a fixed level in the reservoir portion 36, and a third display 123 when the thermal energy source 56 energizes the cleaning solution 100.

What is disclosed is the use as a control system 200 energized by an energy input device shown as a plug 5 having an electrical connection 27 of with a ground wire (three-ended plug). What is also contemplated is the grounding of the device and the use of a plug 5 having an electrical connection 27 without a ground wire. The plug 5 can be rolled up around a support 130, shown in FIG. 8. In one embodiment, a water level detector 77 having a water detector 78 is connected to the control system 200. The level detector 77 serves to prevent the pump 79 from being damaged by overheating when running in air rather than submerged within cleaning solution 100. In one alternate embodiment, the level detector as shown is connected directly to the pump 79.

In one embodiment, the control system 200 is operated by the operator via a display 6 where a green light is the first display 127 with a rotating on/off switch, the second display 32 is an orange light for monitoring the heating element, and the third display 123 is a red light for monitoring the water level. In one embodiment, the user turns the timer 7 clockwise for a desired duration of time. In another embodiment, the timer 7 is set to one-quarter hour. What is also shown is the use of a Ground Fault Circuit Interrupter (GFCI) breaker 8 placed under a protection plate and within the display 6. This breaker allows users to reset the device in case of interruption of the process, such as, but not limited to the malfunction of a component or the failure of the level detector 77 to detect cleaning solution 100 in the reservoir portion 36 or a short circuit.

Persons of ordinary skill in the art appreciate that although the teachings of the disclosure have been illustrated in connection with certain embodiments, there is no intent to limit the invention to such embodiments. On the contrary, the intention of this application is to cover all modifications and embodiments falling fairly within the scope of the teachings of the disclosure.

What is claimed is:

1. An apparatus for washing parts comprising:

an automatic cleaning portion defined by a first cleaning chamber and a second cleaning chamber, the first cleaning chamber including a spray portion disposed above a reservoir portion, wherein the reservoir portion is disposed at a bottom of the first cleaning chamber and includes a first quantity of a single cleaning solution a reservoir level defined by a top surface of the cleaning solution disposed in the bottom of the first cleaning chamber and the spray portion is disposed at a top of the first cleaning chamber and includes a parts support and a spray bar with at least one orifice for distributing the cleaning solution onto the parts, the second cleaning chamber including a soaking tank having a top opening at a top surface of the automatic cleaning portion and a second quantity of the cleaning solution disposed therein having a soaking level defined by a top surface of the cleaning solution disposed in the soaking tank, wherein the soaking tank is disposed in its entirety above the parts support and the soaking level is disposed above the reservoir level, a manual cleaning portion configured as a lid that is movably connected to the automatic cleaning portion by a hinge disposed on a perimeter surface so that the lid pivots between a closed position, that simultaneously prevents access to the first and second cleaning chambers, and an open position, that simultaneously permits access to the first and second cleaning chambers, said manual cleaning portion further defined by a basin including a drain and a fluid distribution device, wherein the fluid distribution device discharges the cleaning solution into the basin for washing parts and for collection through the drain into the first cleaning chamber;

a first thermal energy source disposed in the reservoir portion contiguous with the cleaning solution for controlling a first temperature of the cleaning solution used in connection with the second cleaning chamber and the manual cleaning portion and a second thermal energy source connected to the spray bar for heating the cleaning solution used in connection with the spray portion to a spray temperature that is greater than the first temperature of the cleaning solution; and a pump disposed in the reservoir portion in fluid communication with the spray bar, the soaking tank, and the fluid distribution device for circulating a flow of the cleaning solution from the reservoir portion to at least one of the soaking tank, the fluid distribution device, and the spray bar.

2. The apparatus for washing parts of claim 1, wherein the pump is disposed in the reservoir portion and is submerged in the cleaning solution.

3. The apparatus for washing parts of claim 1, wherein the pump is disposed in the reservoir portion and includes an inlet submerged in the cleaning solution.

4. The apparatus for washing parts of claim 1, further comprising a motor for energizing the pump adjacent to the reservoir portion.

5. The apparatus for washing parts of claim 1, wherein the spray bar includes a first portion disposed adjacent to the parts support and a second portion disposed adjacent to a top end of the spray portion.

6. The apparatus for washing parts of claim 4, wherein the motor is energized for a desired period of time with a cycle timer.

7. The apparatus for washing parts of claim 1, wherein the basin further includes a splashguard.

8. The apparatus for washing parts of claim 1, wherein the fluid distribution device is selected from the group consisting a quick-connect hose fitting and a flow-thru brush.

9. The apparatus for washing parts of claim 1, wherein the automatic cleaning portion further comprises locking wheels located below the first cleaning chamber.

10. The apparatus for washing parts of claim 1, wherein the automatic cleaning portion is in the external shape of a shop tool box.

11. The apparatus for washing parts of claim 1, wherein the basin includes sloped side walls for easy service and cleaning.

12. The apparatus for washing parts of claim 1, wherein a manual valve is located before the fluid distribution device.

13. The apparatus for washing parts of claim 1, wherein the drain further includes an anti-backsplash plate.

14. The apparatus for washing parts of claim 1, wherein the parts support further includes a pull-out rack.

15. The apparatus for washing parts of claim 14, wherein the pull-out rack includes a bottom plate with flow holes.

16. An apparatus for washing parts comprising:

an automatic cleaning portion defined by a first cleaning chamber and a second cleaning chamber, the first cleaning chamber including a spray portion disposed above a reservoir portion, wherein the reservoir portion is disposed at a bottom of the first cleaning chamber and is configured to store and collect a single cleaning solution at a reservoir level and the spray portion includes a parts support and a spray bar with an orifice for distributing the cleaning solution onto the parts, the second cleaning chamber including a soaking tank having a top opening at a top surface of the automatic cleaning portion and the cleaning solution disposed therein at a soaking level, wherein the soaking level is disposed above the reservoir level and an ultrasonic device for generating ultrasonic waves in the soaking tank, for cleaning the parts disposed therein, a manual cleaning portion configured as a lid that is movably connected to the automatic cleaning portion so that the lid pivots between a closed position, that prevents access to the first and second cleaning chambers, and an open position, that permits access to the first and second cleaning chambers, said manual cleaning portion further defined by a basin including a drain and a fluid distribution device, wherein the fluid distribution device discharges the cleaning solution into the basin for washing parts and for collection through the drain into the first cleaning chamber;

a first thermal energy source disposed in the reservoir portion contiguous with the cleaning solution for controlling a first temperature of the cleaning solution used in connection with the second cleaning chamber and the manual cleaning portion and a second thermal energy source connected to the spray bar for heating the cleaning solution used in connection with the spray portion to a spray temperature that is greater than the first temperature of the cleaning solution; and a pump disposed in the reservoir portion in fluid communication with the spray bar, the soaking tank, and the fluid distribution device for circulating a flow of the cleaning solution from the reservoir portion to at least one of the soaking tank, the fluid distribution device, and the spray bar.

* * * * *